US008934658B2

(12) United States Patent
He

(10) Patent No.: US 8,934,658 B2
(45) Date of Patent: Jan. 13, 2015

(54) COIL

(71) Applicant: Jing He, Shenzhen (CN)

(72) Inventor: Jing He, Shenzhen (CN)

(73) Assignees: AAC Acoustic Technologies (Shenzhen) Co., Ltd., Shenzhen (CN); AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 13/858,124

(22) Filed: Apr. 8, 2013

(65) Prior Publication Data

US 2013/0266160 A1 Oct. 10, 2013

(30) Foreign Application Priority Data

Apr. 9, 2012 (CN) ..... 2012 2 0147995 U

(51) Int. Cl.
*H04R 25/00* (2006.01)

(52) U.S. Cl.
USPC ..... 381/408; 381/400; 381/409

(58) Field of Classification Search
USPC ..... 381/176, 399, 190–191, 400–403, 381/405–410
See application file for complete search history.

(56) References Cited

U.S. PATENT DOCUMENTS

| | | | | |
|---|---|---|---|---|
| 3,833,771 | A * | 9/1974 | Collinson | 381/186 |
| 3,898,598 | A * | 8/1975 | Asahi | 381/408 |
| 4,337,379 | A * | 6/1982 | Nakaya | 381/408 |
| 6,154,557 | A * | 11/2000 | Montour et al. | 381/431 |
| 7,174,024 | B1 * | 2/2007 | Suzuki et al. | 381/399 |

* cited by examiner

*Primary Examiner* — Suhan Ni
(74) *Attorney, Agent, or Firm* — Anova Law Group, PLLC

(57) ABSTRACT

A coil includes a first section, a second section spaced from the first section, a third section and a forth section connecting ends of the first and second sections for forming a closed loop. The third section includes a first portion directly contacting to the first section, and a second portion extending from the first portion and directly connecting to the second section, the first portion forms a protrusion away from the fourth section.

5 Claims, 2 Drawing Sheets

COIL

FIELD OF THE INVENTION

The present invention generally relates to the art of coils, more particularly to a hearing aid coil (HAC) used in a transducer for generating sound.

RELATED ART OF THE INVENTION

As the market of portable consumer electronic products growing, electronic devices like mini speaker are widely used, and speakers combining hearing aid function are more and more demanded by users who are hearing-impaired. Usually a hearing aid coil is mounted in a speaker and helps users wearing hearing aid hear sound by electromagnetic induction with audiphones. A coil is generally made by winding metal wire or laser etching.

General speakers are regular shaped like square or circle, but nowadays, shapes of speakers are tend to be irregular. A regular coil may adapt a speaker well when the speaker is also regular, but when the speaker has an irregular shape, the regular coil cannot adapt to the speaker and it will limit the size of the coil thereby limiting the performance of the speaker.

Accordingly, it is necessary to provide an improved coil for solving the problems mentioned above.

DETAILED DESCRIPTION OF THE EXEMPLARY EMBODIMENTS

Reference will now be made to describe two exemplary embodiments of the present disclosure in detail.

The coil is assembled in a speaker especially for providing hearing impaired users with enhanced sound by electromagnetic induction between the coil and a hearing aid fitting into the user's ear.

Embodiment 1

Figure 1:
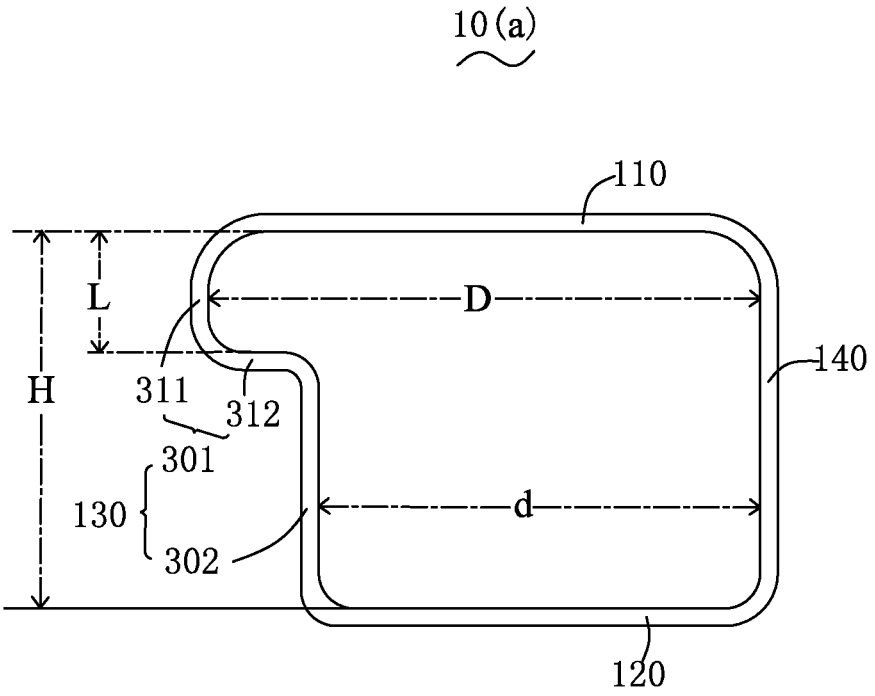
FIG. 1 is an illustrative top-view of a coil in accordance with a first exemplary embodiment of the present disclosure.

Referring to FIG. 1, a coil 10(*a*), in accordance with one exemplary embodiment of the present disclosure, includes a first section 110, a second section 120 spaced from the first section 110, a third section 130 and a forth section 140 connecting ends of the first and second sections for forming a closed loop. It's optional that the first section 110 is parallel to the second section 120.

The third section 130 includes a first portion 301 directly contacting to the first section 110, and a second portion 302 extending from the first portion 301 and directly connecting to the second section 120. The first portion 301 forms a protrusion away from the fourth section 140. Optionally, the first portion 301 includes a first part 311 substantially parallel to the forth section 140 and a second part 312 substantially perpendicular to the forth section 140. The second portion 302 is substantially parallel to the forth section 140. A distance between the first part 311 and the forth section 140 is defined as D, and a distance between the second portion 302 and the forth section 140 is defined as d. In this embodiment, D is larger than d. Alternatively, D may be smaller than d.

A length of the first part 311 is defined as L, and a distance between the first section 110 and the second section 120 is defined as H. In this embodiment, L is smaller than a half of H.

Embodiment 2

Figure 2:
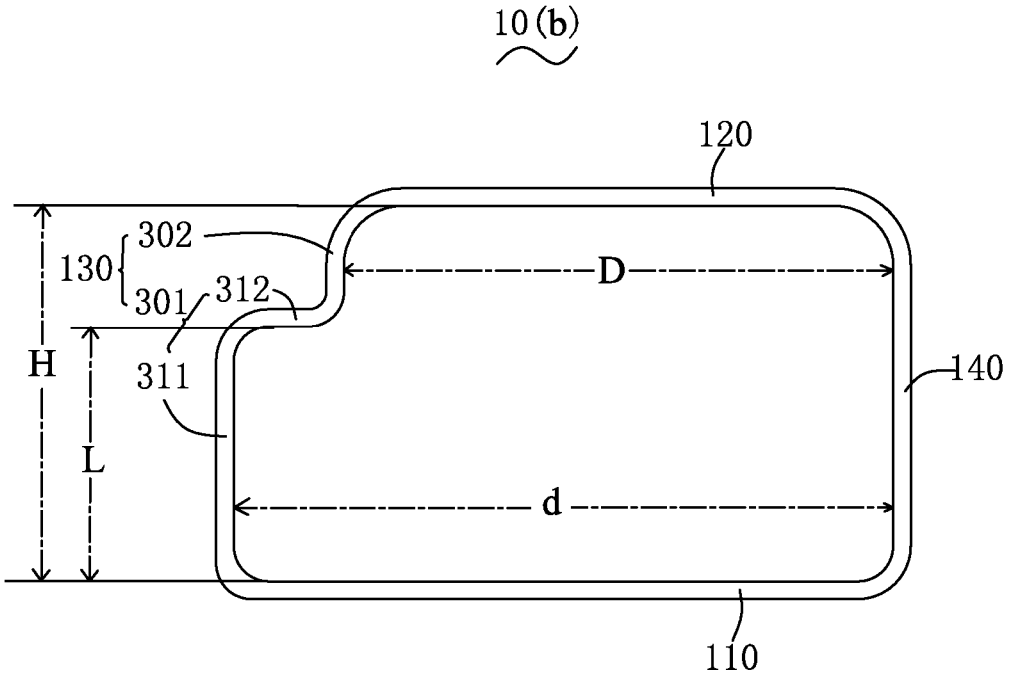
FIG. 2 is an illustrative top-view of a coil in accordance with a second exemplary embodiment of the present disclosure.

Referring to FIG. 2, a coil 10(*b*), in accordance with one exemplary embodiment of the present disclosure, includes a first section 110, a second section 120 spaced from the first section 110, a third section 130 and a forth section 140 connecting ends of the first and second sections for forming a closed loop. It's optional that the first section 110 is parallel to the second section 120.

The third section 130 includes a first portion 301 directly contacting to the first section 110, and a second portion 302 extending from the first portion 301 and directly connecting to the second section 120. The first portion 301 forms a protrusion away from the fourth section 140. Optionally, the first portion 301 includes a first part 311 substantially parallel to the forth section 140 and a second part 312 substantially perpendicular to the forth section 140. The second portion 302 is substantially parallel to the forth section 140. A distance between the first part 311 and the forth section 140 is defined as D, and a distance between the second portion 302 and the forth section 140 is defined as d. In this embodiment, D is larger than d. Alternatively, D may be smaller than d.

A length of the first part 311 is defined as L, and a distance between the first section 110 and the second section 120 is defined as H. In this embodiment, L is larger than a half of H. Optionally, L may be equal to a half of H.

When a speaker is irregular, coil 10(*a*) or coil 10(*b*) can adapt to the shape of the speaker, and maximize the coil thereby optimizing the performance of the speaker.

While the present invention has been described with reference to specific embodiments, the description of the invention is illustrative and is not to be construed as limiting the invention. Various of modifications to the present invention can be made to the exemplary embodiments by those skilled in the art without departing from the true spirit and scope of the invention as defined by the appended claims.

What is claimed is:

1. A coil for a transducer generating sound, comprising:

a first section;

a second section spaced from the first section;

a third section connecting two ends of the first and second sections;

a fourth section connecting the other two ends of the first and second sections for forming a closed loop; wherein the third section includes a first portion directly contacting to the first section, and a second portion extending from the first portion and directly connecting to the second section, the first portion forms a protrusion away from the fourth section;

the protrusion includes a first part substantially parallel to the forth section and a second part substantially perpendicular to the forth section.

2. The coil as described in claim 1, wherein the second portion is substantially parallel to the forth section.

3. The coil as described in claim 2, wherein a distance between the first part and the forth section is larger than a distance between the second portion and the forth section.

4. The coil as described in claim 1, wherein the length of the first part is smaller than a half of the distance between the first section and the second section.

5. The coil as described in claim 1, wherein the length of the first part is larger than a half of the distance between the first section and the second section.

* * * * *